United States Patent [19]

Osawa et al.

[11] Patent Number: 5,073,464

[45] Date of Patent: Dec. 17, 1991

[54] METHOD OF PROCESSING ELECTROPHOTOGRAPHIC LITHOGRAPHIC PRINTING PLATE PRECURSORS

[75] Inventors: Sadao Osawa; Hisao Ohba, both of Shizuoka, Japan

[73] Assignee: Fuji Photo Film Co., Ltd., Kanagawa, Japan

[21] Appl. No.: 416,091

[22] Filed: Oct. 2, 1989

[30] Foreign Application Priority Data

Oct. 3, 1988 [JP] Japan ..... 63-247540

[51] Int. Cl.[5] ..... G03C 5/00

[52] U.S. Cl. ..... 430/30; 430/302; 430/309; 430/49; 355/208; 355/246; 354/298

[58] Field of Search ..... 430/30, 302, 309, 49; 354/298; 355/208, 246

[56] References Cited

U.S. PATENT DOCUMENTS

| | | | |
|---|---|---|---|
| 3,559,555 | 2/1971 | Street | 354/298 |
| 3,680,463 | 8/1972 | Attridge et al. | 354/298 |
| 3,787,689 | 1/1974 | Fidelman | 354/298 |
| 4,314,753 | 2/1982 | Kaufmann | 354/298 |
| 4,537,496 | 8/1985 | Ohba et al. | 430/302 |
| 4,603,956 | 8/1986 | Baker | 354/298 |
| 4,647,172 | 3/1987 | Batchelder et al. | 354/298 |
| 4,851,311 | 7/1989 | Millis et al. | 430/30 |
| 4,882,246 | 11/1989 | Ohba et al. | 430/30 |
| 4,963,927 | 10/1990 | Ishihara | 355/208 |

FOREIGN PATENT DOCUMENTS

| | | | |
|---|---|---|---|
| 0004508 | 5/1989 | PCT Int'l Appl. | 430/30 |

*Primary Examiner*—Richard L. Schilling
*Assistant Examiner*—Thomas R. Neville
*Attorney, Agent, or Firm*—Sughrue, Mion, Zinn, Macpeak & Seas

[57] ABSTRACT

A method for processing an electrophotographic lithographic printing precursor comprising a photoconductive layer provided on a conductive substrate, the photoconductive layer having a toner image formed thereon by an electrophotographic process, comprising measuring electronically the area of the nonimage area to be processed, treating the precursor with a processing fluid from a processing fluid reservoir to remove the nonimage area of the photoconductive layer, and adding replenisher by automatic means in accordance with the area of the measured nonimage area.

7 Claims, 1 Drawing Sheet

METHOD OF PROCESSING ELECTROPHOTOGRAPHIC LITHOGRAPHIC PRINTING PLATE PRECURSORS

FIELD OF THE INVENTION

This invention relates to a processing method for removing the nonimage area from a lithographic printing plate precursor during production of the lithographic printing plate, which precursor has as its image area a toner image formed by an electrophotographic process on a photoconductive layer and, in particular, to a method of processing electrophotographic lithographic printing plate precursors in which processing can be performed consistently, while avoiding the reduction of processing capability in the processing fluid when continuously processing a large number of the above-mentioned precursors using automatic processing equipment.

BACKGROUND TO THE INVENTION

Currently, photosensitive lithographic printing plates (PS plates), etc., are being used as lithographic offset printing plates. These have either a negative photosensitive agent consisting mainly of acrylic monomers or prepolymers, or a positive photosensitive agent composed mainly of phenol resin and diazo compounds. However, these are all of low sensitivity, so that plate making is effected by contact exposure of a silver salt photographic film precursor on which the image has been pre-recorded. Over recent years, however, electronic editing systems have come into practical use: advances in computer image processing and large capacity data storage and data communications technologies have made it possible to handle all processes from entering text to correcting, editing, layout and binding by computer in an integrated fashion. Such systems are able to send their output to terminal plotters in distant locations instantaneously via high speed communications networks or satellite links. The degree of demand for electronic editing systems is particularly high in the field of newspaper printing, where speed is a requirement. In addition, with the development of ultralarge capacity recording media such as optical disks, it is considered that for fields in which printing plates are duplicated as they are required by storing originals in the form of baseplate films, it will become possible to store originals on such recording media in the form of digital data.

Known printing plate materials (printing plate precursors) in which electrophotography is made use of are, for example, zinc oxide/resin dispersion system offset printing plate materials as disclosed in, for example, JP-B-47-47610, JP-B-48-40002, JP-B-48-18325, JP-B-51-15766 and JP-B-51-25761 (the term "JP-B" as used herein refers to an "examined Japanese patent publication") and these are used after the formation of a toner image by electrophotographic methods, and after moistening with an oil-desensitizing solution (for example, an acidified water solution containing ferricyanide salts or ferrocyanide salts) to make the nonimage area oil-desensitive. Offset printing plates which have been processed in this manner have the capacity to withstand printing 5,000 to 10,000 sheets. However, they are not appropriate for printing, more than this and have a number of disadvantages: static electrical properties are poor and image quality deteriorates when a composition having an oil-desensitive property is employed. In addition, there is the disadvantage that harmful cyanide compounds are used as the oil-desensitizing solutions.

The resin printing plate having organic photoconductive materials disclosed in, for example, JP-B-37-17162, JP-B-38-7758, JP-B-45-39405, JP-B-52-2437 make use of an electrophotographic photoreceptor in which a photoconductive insulated layer, in which oxazole or oxadiazole compounds are bound by a styrene/maleic anhydride copolymer, is set on a sand-roughened aluminum plate; after a toner image is formed electrophotographically on this photoreceptor, a printing plate is made by removing the nonimage area with an alkaline organic solvent.

In relation to the above-mentioned method, a method has also been proposed for using an alkaline aqueous solution containing an organic solvent as the processing fluid for removing the nonimage area.

In the processing of the above-mentioned electrophotographic photoreceptor having a toner image on the photoconductive layer (the lithographic printing plate precursor), the above-mentioned processing fluid is applied to the surface of the photoconductive layer by spraying with a spray or by immersion, etc., or is spread over the surface with a brush roller, etc., and the nonimage area of the photoconductive layer is removed.

When carrying out this sort of processing in respect of a large number of electrophotographic photoreceptors using the same processing equipment, it is necessary to change or supplement the processing fluid because, as the processing progresses, the processing fluid deteriorates by the consumption of a certain component of the processing fluid and by the decrease of the pH of the fluid due to the involving of a $CO_2$ gas to the fluid from air, insufficient elution has an adverse effect on the graphic quality of what is printed. Checking the extent to which this processing fluid has deteriorated and replenishing the processing fluid is troublesome. In addition, replenishing processing fluid after it has deteriorated leads to printing plates which are poor in parts.

For this reason, it is desirable to add processing fluid (replenisher) automatically: for example, adding the replenisher in accordance with processing time or processing parameters for the electrophotographic photoreceptor (for example, the number and length of photoreceptors introduced into the processing machine), has been considered. However, the area of the toner image which is formed on this type of photoreceptor differs with different photoreceptors, and consequently, the area of the nonimage area which is removed differs and therefore the degree of deterioration of the processing fluid differs with different photoreceptors, making it ultimately impossible to add fluid correctly.

SUMMARY OF THE INVENTION

This invention offers a method of processing which permits the processing of a large number of electrophotographic photoreceptors having toner images formed on the photoconductive layer by means of an electrophotographic process, while automatically adding the appropriate amount of replenisher at all times, enabling the complete and stable removal of the nonimage area.

The present inventors have discovered that it is possible to achieve the above-mentioned objectives by applying, to the removal of the nonimage area of the photoconductive layer in the electrophotographic photoreceptor mentioned above, a method of supplementing developing solution in automatic developing equipment for photosensitive lithographic printing plates proposed earlier by the present applicant (JP-A-60-252351) (the term "JP-A" as used herein refers to a "published unexamined Japanese patent application"), and have produced this invention.

Thus, in a processing method in which an electrophotographic lithographic printing plate precursor is processed in a processing fluid to remove the nonimage area, the image area being composed of a toner image formed by an electrophotographic process on a photoconductive layer provided on a conductive substrate, this invention is a processing method for an electrophotographic lithographic printing plate precursor wherein replenisher is added to the processing fluid in accordance with the area of the nonimage area being processed.

BRIEF DESCRIPTION OF THE ACCOMPANYING DRAWINGS

DETAILED DESCRIPTION OF THE INVENTION

Figure 1:
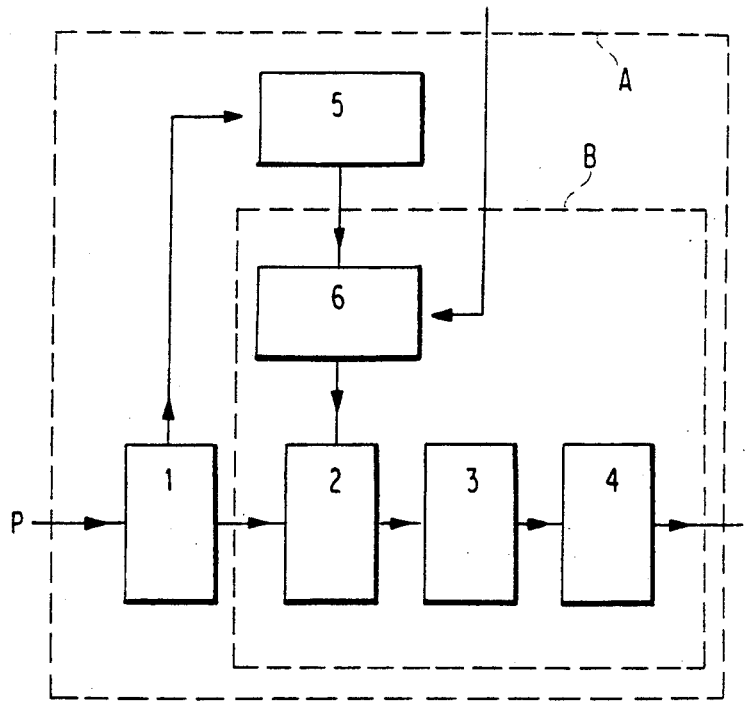
FIG. 1 represents a block diagram which gives an actual example of the process used in this invention.

This invention is described in further detail below.

Materials for the conductive substrate used in the electrophotographic photoreceptor in this invention include plastic sheets which have a conductive surface, paper which has been rendered conductive and nonpermeable to solvents, and conductive plates with hydrophilic surfaces, i.e., aluminum plates, zinc plates, bimetallic plates such as copper/aluminum, copper/stainless steel or chrome/copper plates, or trimetallic plates such as chrome/copper/aluminum, chrome/lead/steel, or chrome/copper/stainless steel plates. A desirable plate thickness is between 0.1 and 3 mm; plates between 0.1 and 0.5 mm thick are particularly preferred. Of all these different substrates, aluminum plates are the best to use. The aluminum used in the aluminum plates in this invention has as its main component pure aluminum or aluminum alloy which contains minute quantities of other atoms. No particular composition is required, and well-known and well-used materials are suitable for use.

Aluminum plates which have been sanded and anodized by known methods may be used. Before sanding, a degreasing process may be carried out using an alkaline aqueous solution or a surfactant as desired in order to remove the rolling grease from the surface of the aluminum plate. Sanding is then carried out. The sanding process involves methods of roughening the surface mechanically, dissolving the surface electrochemically, and selectively dissolving the surface chemically. For roughening the surface mechanically, it is possible to use known methods variously termed ball abrading, brush abrading, blast abrading or buffing. Electrochemical roughening techniques involve methods of applying direct or alternating current in hydrochloric acid or nitric acid electrolytic solutions. It is also possible to use a method combining both as disclosed in JP-A-54-63902.

The aluminum plate which has been roughened in this way is, as required, subjected to alkali etching and a neutralization process.

The aluminum plate which has been processed in this way is then anodized. Sulfuric acid, phosphoric acid, oxalic acid, chromic acid or mixtures of these may be employed as the electrolyte used in the process of anodizing and the concentrations are determined appropriately in accordance with the type of electrolyte. Anodization processing conditions vary according to the electrolyte used; overall, there are no specific requirements, but in general, an electrolyte concentration which is between 1 and 80% by weight of the solution, a temperature of between 5° and 70° C., a current density of between 5 and 60 A/dm$^2$, a voltage of between 1 and 100 V, and an electrolysis time of between 10 seconds and 50 minutes will be suitable. An anodized film weight of between 0.1 and 10 g/m$^2$ will be suitable, but this is preferably in a range between 1 and 6 g/m$^2$.

It is possible to obtain an electrophotographic photoreceptor by providing a known electrophotographic photosensitive layer (photoconductive layer) on the conductive substrates obtained in this way.

It is possible to use a great number of well-known organic and inorganic compounds for the photoconductive material used in the photoconductive layer. For example, it is possible to use such inorganic photoconductive materials such as selenium, selenium/tellurium, cadmium sulfide and zinc oxide, etc., as known dispersible photoconductive materials. In addition, the following organic conductive compounds exist:

(1) A triazole derivative disclosed in the specification of, for example, U.S. Pat. No. 3,112,197.

(2) An le derivative disclosed in the specification of, for example, U.S. Pat. No. 3,189,447.

(3) An imidazole derivative disclosed in, for example, JP-B-37-16096.

(4) A polyarylalkane derivative disclosed in the specifications of, for example, U.S. Pat. Nos. 3,615,402, 3,820,989, 3,542,544 and JP-B-45-555, JP-B-51-10983, JP-A-51-93224, JP-A-55-108667, JP-A-55-156953 and JP-A-56-36656.

(5) Pyrazoline derivatives and pyrazolone derivatives disclosed in the specifications of, for example, U.S. Pat. Nos. 3,180,729, 4,278,746 and JP-A-55-88064, JP-A-55-88065, JP-A-49-105537, JP-A-55-51086, JP-A-56-80051, JP-A-56-88141, JP-A-57-45545, JP-A-54-112637 and JP-A-55-74546.

(6) A phenylenediamine derivative disclosed in the specifications of, for example, U.S. Pat. No. 3,615,404 and JP-B-51-10105, JP-B-46-3712, JP-B-47-28336, JP-A-54-83435, JP-A-54-110836 and JP-A-54-119925.

(7) An arylamine derivative disclosed in the specifications of, for example, U.S. Pat. Nos. 3,567,450, 3,180,703, 3,240,597, 3,658,520, 4,232,103, 4,175,961, 4,012,376, West German Patent (DAS) 1,110,518 and JP-B-49-35702, JP-B-39-27577, JP-A-55-144250, JP-A-56-119132 and JP-A-56-22437.

(8) An amino-substituted chalcone derivative disclosed in the specification of, for example, U.S. Pat. No. 3,526,501.

(9) An N,N-bicarbazyl derivative disclosed in the specification of, for example, U.S. Pat. No. 3,542,546.

(10) An oxazole derivative disclosed in the specification of, for example, U.S. Pat. No. 3,257,203.

(11) A styryl anthracene derivative disclosed in, for example, JP-A-56-46234.

(12) A fluorenone derivative disclosed in, for example, JP-A-54-110837.

(13) A hydrazone derivative disclosed in the specifications of, for example, U.S. Pat. No. 3,717,462 and JP-A-54-59143 (corresponding to U.S. Pat. No. 4,150,987), JP-A-55-52063, JP-A-55-52064, JP-A-55-

46760, JP-A-55-85495, JP-A-57-11350, JP-A-57-148749 and JP-A-57-104144.

(14) A benzidine derivative disclosed in the specifications of, for example, U.S. Pat. Nos. 4,047,948, 4,047,949, 4,265,990, 4,273,846, 4,299,897 and 4,306,008.

(15) A stilbene derivative disclosed in, for example, JP-A-58-190953, JP-A-59-95540, JP-A-59-97148, JP-A-59-195658 and JP-A-62-36674.

In addition, apart from the above-mentioned low molecular photoconductive compounds, the following high molecular compounds may also be used.

(16) A polyvinylcarbazole and its derivative disclosed in, for example, JP-B-34-10966.

(17) Vinyl polymers such as polyvinylpyrene, polyvinylanthracene poly-2-vinyl-4-(4'-dimethylaminophenyl)-5-phenyloxazole, and poly-3-vinyl-N-ethylcarbazole disclosed in, for example, JP-B-43-18674 and JP-B-43-19192.

(18) Polyacenaphthylene, polyindene, and copolymer of styrene and acenaphthylene disclosed in, for example, JP-B-43-19193.

(19) Condensed resins such as pyrene-formaldehyde resin, brompyrene-formaldehyde resin, and ethylcarbazoleformaldehyde resin disclosed in, for example, JP-B-56-13940.

(20) A triphenylmethane polymer disclosed in, for example, JP-A-56-90883 and JP-A-56-161550.

In addition, in order to improve the sensitivity of the photoconductor and obtain the desired photosensitivity wavelength band, it is possible to use a variety of pigments and dyes. These are, for example:

(1) Monoazo, bisazo and trisazo pigments disclosed in, for example, U.S. Pat. Nos. 4,436,800, 4,439,506, JP-A-47-37543, JP-A-58-123541, JP-A-58-192042, JP-A-58-219263, JP-A-59-78356, JP-A-60-179746, JP-A-61-148453, JP-A-61-238063, JP-B-60-5941 and JP-B-60-45664.

(2) Phthalocyanine pigments such as metallic or nonmetallic phthalocyanine disclosed in, for example, U.S. Pat. Nos. 3,397,086 and 4,666,802.

(3) Perylene-based pigments disclosed in, for example, U.S. Pat. No. 3,371,884.

(4) Indigo and thioindigo derivatives disclosed in, for example, British Patent 2,237,680.

(5) A quinacridone-based pigment disclosed in, for example, British Patent 2,237,679.

(6) A polycyclic quinone-based pigment disclosed in, for example, British Patent 2,237,678, JP-A-59-184348 and JP-A-62-28738.

(7) A bis-benzimidazole-based pigment disclosed in, for example, JP-A-47-30331.

(8) A squalenium salt-based pigment disclosed in, for example, U.S. Pat. Nos. 4,396,610 and 4,644,082.

(9) An azulenium salt-based pigment disclosed in, for example, JP-A-59-53850 and JP-A-61-212542.

In addition, it is possible to use the following known compounds disclosed in *Sensitizers* (Zokanzai), p. 125, Kodansha (1987), *Electrophotography* (*Denshi Shashin*), 12, 9 (1973), *Organic Synthesis Chemistry* (*Yuki Gosei Kagaku*), 24, No 11, 1010 (1966), etc., as sensitizers. For example:

(10) A pyrylium-based pigment disclosed in, for example, U.S. Pat. Nos. 3,141,770, 4,283,475, JP-B-48-25658 and JP-A-62-71865.

(11) A triarylmethane-based dye disclosed in, for example, *Applied Optics Supplement*, 3, 50 (1969) and JP-A-50-39548.

(12) A cyanine-based dye disclosed in, for example, U.S. Pat. No. 3,597,196.

(13) A styryl-based dye disclosed in, for example, JP-A-60-163047, JP-A-59-164588 and JP-A-60-252517.

One, or two or more types of these organic photoconductive materials may be used together.

In order to improve the sensitivity of the photoconductive layer in this invention it is possible to use, for example, electron attracting compounds such as trinitrofluorenone, chloranil, or tetracyanoethylene, or such compounds as are disclosed in JP-A-58-65439, JP-A-58-102239, JP-A-58-129439 and JP-A-62-71965.

With regard to the photoreceptor used in electrophotographic plate making, there will be cases in which the photoconductive compound itself has the capacity to act as a film and bonding resins may be employed when compounds which do not have this capacity are used. The well-known resins employed in the field of electrophotography may be used as the bonding resin. When making printing plates by using photoreceptors for electrophotographic plate making, it is necessary to remove the nonimage area of the photoconductive layer at the end. However, this process is determined by the relative relationships of the resistance of the toner image to the removal processing fluid and solubility, swellability, film detachability and permeability of the photoconductive layer to the removal processing fluid, so it is not possible to generalize. The following high molecular compounds which swell, detach, disperse or dissolve in the removal processing fluid are preferred for use as the bonding resins.

Specifically, mention may be made, for example, of copolymers of monomers containing acid anhydride groups or monomers containing carboxylic acids such as acrylic acid, methacrylic acid, itaconic acid, crotonic acid, maleic acid, maleic anhydride, or fumaric acid with acrylic acid esters, methacrylic acid esters, styrene, vinyl acetate and the like such as copolymers of styrene and maleic anhydride, copolymers of styrene and maleic anhydride monoalkyl ester, copolymers of methacrylic acid and methacrylic acid ester, copolymers of styrene, methacrylic acid and methacrylic acid ester, copolymers of acrylic acid and methacrylic acid ester, copolymers of styrene, acrylic acid and methacrylic acid ester, copolymers of vinyl acetate and crotonic acid, copolymers of vinyl acetate, crotonic acid and methacrylic acid ester or copolymers which contain polymers with methacrylamides, vinyl pyrrolidone, phenolic hydroxyl groups, sulfonic acid groups, sulfonamide groups, sulfonimide groups; phenolic resin, partially saponified vinyl acetate resin, xylene resin, or polyvinyl butyral and other such vinyl acetal resins.

When copolymers which contain monomers having acid anhydride groups or carboxylic acid groups as copolymeric components or phenol resins are used as the photoreceptor in electrophotographic plate making, the charge retentivity of the photoconductive layer is high and results are good.

Copolymers of styrene and maleic anhydride are preferred as the copolymers which contain monomers having acid anhydride groups as the copolymeric constituents. In addition, it is also possible to use a half ester of this copolymer. For the copolymers which contain monomers having carboxylic acid groups as the copolymer constituents, it is preferable to use copolymers of two or more components of acrylic acid or methacrylic acid and acrylic acid or methacrylic acid alkyl ester, aryl ester or aralkyl ester. Preferred examples are also vinyl acetate and crotonic acid copolymers and terpolymers of vinyl acetate, a vinyl ester of a carboxylic acid with between 2 and 18 carbon atoms and crotonic acid. As a particularly preferred phenolic resin, it is possible to mention the novolak resin which is obtained by condensing phenol, o-cresol, m-cresol or p-cresol with formaldehyde or acetaldehyde under acidic conditions. It is possible to use bonding resins singly, or in mixtures of two or more types.

When using bonding resins and photoconductive compounds, sensitivity will fall if the quantity of photoconductive compound included is small, so therefore it is preferable to use at least 0.05 part by weight of the photoconductive compound to 1 part by weight of the bonding resin and more preferable when a range of 0.1 part by weight or more is used. Further, if the photoconductive layer is too thin, it cannot be electrostatically charged sufficiently to develop the image, while if it is too thick, horizontal etching, known as side etching, will occur when the removal processing is carried out and a satisfactory image will not be obtained. The thickness used should be between 0.1 and 30 μm, with the most desirable range being between 0.5 and 10 μm.

The printing plate used in electrophotographic plate making in this invention consists of a photoconductive layer coated on a conductive substrate in accordance with a common method. In producing the photoconductive layer, there are techniques in which the components which make up the photoconductive layer are in the one layer and techniques in which they are separated between two or more layers. For example, methods which use separation into layers which have charge carrier generation materials and charge carrier transmission materials in different layers to each other are well known and it is possible to use any of these methods. The coating fluid may be made by dissolving the components of the photoconductive layer in a suitable solvent. Components as pigments which are insoluble in the solvent are dispersed as grains of between 0.1 and 5 μm by dispersers such as ball mills, paint shakers, dynomills, or attritors. Bonding resins or other additives which are used in the photoconductive layer may be added when dispersing the pigment, or may also be added after dispersal. The coating liquid produced in this way can be coated and dried on the substrate by such known methods as rotary coating, blade coating, knife coating, reverse roll coating, dip coating, rod bar coating or spray coating and it is possible in this way to obtain a printing plate for use in electrophotographic plate making. Suitable solvents for use in making the coating liquid are halogenated hydrocarbons such as dichloromethane, dichloroethane, chloroform; alcohols such as methanol and ethanol; ketones such as acetone, methyl ethyl ketone and cyclohexanone; glycol ethers such as ethylene glycol monomethyl ether and 2-methoxy ethyl acetate; ethers such as tetrahydrofuran and dioxane; and esters such as ethyl acetate and butyl acetate.

It is possible to add other additives to the photoconductive layer apart from the photoconductive compounds and bonding resins, such as plasticizers and surfactants, as required, for the purposes of improving the flexibility of the photoconductive layer, or improving film properties such as the coated surface form and the softness of the photoconductive layer. Plasticizers which may be mentioned are biphenyl, biphenyl chloride, o-terphenyl, p-terphenyl, dibutyl phthalate, dimethyl glycol phthalate, dioctyl phthalate, triphenyl phosphate, etc.

As far as electrophotographic plate making printing plates used in this invention are concerned, it is possible to make the above-mentioned electrophotographic photoreceptor by means of known processes. This is to say, an electric charge is applied essentially uniformly in a darkroom and a static electrical latent image is formed by image exposure. Methods of exposure which can be mentioned are scanning exposure using a semiconductor laser or a helium/neon laser, etc., reflective image exposure with such light sources as xenon, tungsten or fluorescent lamps, or contact exposure via a transparent positive film. The above-mentioned static electrical latent image is developed by means of a toner. The methods of developing images are the conventionally known ones, for example, it is possible to use a variety of methods such as cascade, magnetic brush, powder cloud or fluid developing. Of these, fluid developing has the capacity to produce very fine images and is most suitable for the production of printing plates. Well known methods of fixing can be used for the toner image produced: for example, heat fixing, pressure fixing or solvent fixing.

The toner image formed in this manner is caused to act as a resist and a printing plate can be produced by removing the nonimage area of the photoconductive layer with the processing fluid.

It is possible to use any desired processing fluid which is capable of removing the photoconductive insulating layer as the processing fluid for removing the nonimage area of the photoconductive insulating layer after formation of the toner image. There is nothing which is particularly specified, but it is desirable to use an alkaline processing agent. Alkaline processing agents which can be mentioned in this connection are aqueous solutions which contain alkaline compounds, organic solvents which contain alkaline compounds, or mixtures of aqueous solutions containing alkaline compounds and organic solvents. Alkaline compounds which can be mentioned are any desired organic or inorganic alkaline compound such as sodium hydroxide, potassium hydroxide, sodium carbonate, sodium, silicate, potassium silicate, sodium metasilicate, potassium metasilicate, sodium phosphate, potassium phosphate, ammonia and amino alcohols such as monoethanolamine, diethanolamine or triethanolamine. For the removal processing fluid solvent, it is possible to use, as previously stated, water or a variety of organic solvents. However, it is preferable to use water as the main removal processing fluid from the point of view of smell and pollution. If water is used as the main removal processing fluid, it is possible, as desired, to add all sorts of organic solvents. Desirable organic solvents are lower alcohols or aromatic alcohols such as methanol, ethanol, propanol, butanol, benzyl alcohol and phenetyl alcohol, ethylene glycol, diethylene glycol, triethylene glycol, polyethylene glycol and varieties of cellosolve; and amino alcohols such as monoethanolamine, diethanolamine and triethanolamine, etc. In addition, it is possible to use substances containing surfactants and antifoaming agents as well as various other additives as desired in the removal processing fluid.

Regarding the toner which forms the image areas, it is preferable that it contains resin components which have a resistance against the above-mentioned removal processing fluid. Resin components which may be mentioned are, for example: acrylic resins which use such substances as methacrylic acid and methacrylic acid ester, vinyl acetate resin, copolymers of vinyl acetate and ethylene or vinyl chloride, etc.; vinyl chloride resins, vinylidene chloride resins, vinyl acetal resins such as polyvinyl butyral, polystyrene, copolymers of styrene, butadiene, and/or methacrylic acid ester; polyethylene, polypropylene and their chlorides, polyester resins (for example, polyethylene terephthalate, polyethylene isophthalate and bisphenol A polycarbonates), polyamide resins (for example, polycapramide, polyhexamethylene adipamide, polyhexamethylene sebacamide), phenol resins, xylene resins, alkyd resins, vinyl modified alkyd resins, gelatin and cellulose ester derivatives such as carboxymethyl cellulose; polyolefin and wax, etc.

In regard to the photoreceptor used in electrophotographic plate making employed in this invention it is possible to use, as required, between the above-mentioned conductive substrate and photoconductive layer: casein, polyvinyl alcohol, ethyl cellulose, phenol resin, styrene/maleic anhydride copolymer, polyacrylic acid, monoethanolamine, diethanolamine, triethanolamine, tripropanolamine, triethanolamine and their hydrochlorides, oxalates, phosphates, monoamino monocarbonic acids such as amino acetic acid, alanine, etc.; oxyamino acids such as dihydroxyethyl glycine, serine, threonine, etc.; amino acids which contain sulfur such as cysteine, cystine, monoamine dicarboxylic acids such as aspartic acid and glutamic acid; diamino monocarboxylic acids such as ricin; amino acids which have aromatic nuclei such as p-hydroxyphenyl glycine, phenyl alanine and anthranilic acid; amino acids which have heterocyclic rings such as tryptophan and proline; aliphatic amino sulfonic acids such as sulfamic acid and cyclohexyl sulfamic acid; (poly)amino polyacetic acids such as ethylenediaminetetraacetic acid, nitrilotriacetic acid, iminodiacetic acid, hydroxyethyliminodiacetic acid, hydroxyethyl ethylenediaminetriacetic acid, ethylenediaminediacetic acid, cyclohexanediaminetetraacetic acid, diethylenetriaminepentaacetic acid, glycol ether diaminetetraacetic acid; and their compounds in which one or all acid groups are sodium, potassium, calcium or ammonium salts, to form intermediate layers for the purpose of improving adhesion between the above-mentioned substrate and photoconductive layer, static electrical properties of the photoconductive layer, removability and/or printing characteristics.

In addition, it is also possible to provide the photoconductive layer, as desired, with an overcoat layer, which can be removed when the photoconductive layer is removed, for the purpose of improving the static electrical properties of the photoconductive layer, developing qualities on developing the toner, or image quality. This overcoat layer can be matted mechanically, or a resin layer which includes a matting agent may be used. Matting agents include silicon dioxide, zinc oxide, titanium oxide, zirconium oxide, glass particles, alumina, starch, copolymer particles (for example, polymethyl methacrylate, polystyrene or phenol resin or other such particles) and matting agents disclosed in the specifications of U.S. Pat. Nos. 2,710,245 and 2,992,101. Two or more of these may be used in combination. The resin which is used in the resin layer which contains the matting agent may be selected to suit the removal processing fluid which is used. Specifically, for example, there are gum arabic, glue, gelatin, casein, types of cellulose compound (for example, viscose, methyl cellulose, ethyl cellulose, hydroxyethyl cellulose, hydroxypropyl methyl cellulose and carboxymethyl cellulose, etc.), varieties of starch (for example, soluble starch and modified starch, etc.), polyvinyl alcohol, polyethylene oxide, polyacrylic acid, polyacrylamide, polyvinyl methyl ether, epoxy resin, phenolic resin (novolak phenolic resins are particularly preferred) polyamide and polyvinyl butyral, etc.

A static electric charge is applied to the above-mentioned electrophotographic photoreceptor and corona discharge processing is effected; after the image is exposed, it is developed and a toner image is formed.

In this invention, the electrophotographic lithographic printing plate precursor with which a toner image is formed on the photoconductive layer in this way is fed to a processor; processing fluid is sprayed on the surface of the photoconductive layer, or the processing fluid is brought into contact by means of passing the plate through the processing fluid, or it is brushed by means of a brush roller to remove the nonimage area of the photoconductor layer, the hydrophilic surface of the aluminum plate, etc., which is below the photoconductive layer is exposed and a lithographic printing plate is formed.

In this situation, some of the processing fluid is carried along with the precursor, but most of the fluid remains in the processing tank. This means that the remaining processing fluid deteriorates as precursors are processed and, therefore, in this invention, it has been arranged so that replenisher is added automatically in accordance with the area of the portion which is to be dissolved and removed, that is to say, the nonimage area of each precursor. Thus, the processing equipment used in this invention measures the area of that nonimage area (or the image area) for each precursor which is processed, as mentioned above, and is provided with a mechanism which automatically adds a replenisher in an amount in accordance with this area. The composition and the amount of the replenisher to be added are determined based on the results of previously conducted experimentation under several conditions. In a digital direct type printing plate, measuring of the area of the image area can be carried out using a digital signal occurred at a laser beam exposure to the surface of the plate after charge, and the signal is treated by the image area measuring meter.

In a printing plate having been developed with toner, measuring of the area of the nonimage area of the photoconductive layer surface is carried out using an image surface measuring instrument consisting of a photoelectronic detector (surface area measuring meter) composed of a photodiode which carries out a photoelectric conversion of a reflected light which is provided by irradiating a visible light or, for example, a helium-neon gas laser beam (wavelength 633 nm) to the surface of the plate to be measured, an operational amplifier to which the output from the photodiode is input and attached electric circuit, an amplifier circuit which amplifies the signal so detected, a multiplexor which selectively outputs the signal from the amplifier circuit in accordance with an operation processing program, an AD converter whose purpose is to convert the output from the multiplexor into a digital signal, and microprocessors, ROMs, RAMs and equipment which has other related functions. For example, the area of the nonimage area is measured by irradiating the surface of the photoconductive layer with a diffuse light and measuring the reflected light with the photoelectronic detector which converts the measured light to an electronic signal, and the signal drives an automatic means for adding a replenisher. The photoelectronic detector is positioned at an angle of reflection with respect to the angle of incidence of the diffuse light source.

Another method is to use a camera tube to detect differences in color density between the image and nonimage areas on the surface of the plate and process the data detected in the same way, by which means it is possible to measure the surface area of the image area or the nonimage area. A variety of other ways of measuring the surface area apart from the two above-mentioned methods and equipment are known, and it is possible to use these known techniques for the purposes of this invention. In embodiments of these known techniques, the precursors may be positioned in a fixed arrangement and an area measuring meter with sensing heads arrayed in a line is caused to move and scan the plate surface. Another possible configuration which is satisfactory is to run the plates through a processing machine in order to process them and have them pass beneath a fixed area measuring meter, utilizing the movement of the plates in order to have the surface area measuring meter scan them. For example, a video camera is used as the photoelectronic detector, and measurement of the nonimage area is conducted by converting a video signal made by scanning the surface of the image area with the video camera in accordance with an operation processing program.

The present invention is further described by reference to the following example, but the present invention is not to be construed as being limited thereto. Unless otherwise indicated, all parts and percents are by weight.

EXAMPLE

FIG. 1 represents a block diagram which gives an example of the processing procedure used for this invention. In this diagram, P represents the electrophotographic photoreceptor (precursor) which forms the toner image on the photoconductive layer by means of an electrophotographic process; 1 represents the surface area measuring meter which measures the surface area of the nonimage area of the photoconducting layer of precursor P; 2 is the processing fluid tank which elutes the nonimage area; 3 is the water washing tank; 4 is a dryer; 5 is a microcomputer; and 6 is a mechanism for adding replenisher to the processing tank 2. As indicated by the broken lines in this diagram, it is possible for this processing equipment to be arranged as in A in which the surface area measuring meter (1) is fitted inside the equipment; or as in B where it is positioned outside the equipment. In the case of configuration B, there is an electrical connection from the surface area measuring meter (1) to the microcomputer (5) to the replenisher adding mechanism (6).

Figure 2:
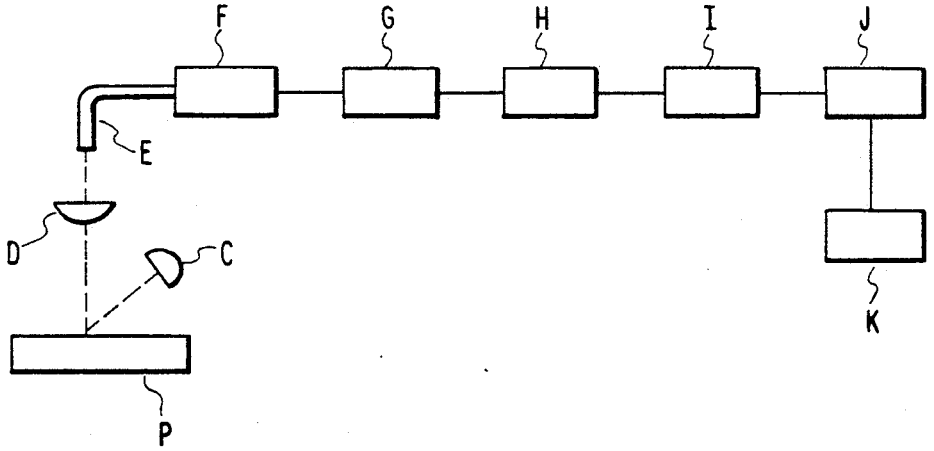
FIGS. 2 and 3 represent embodiments for measuring nonimage area in this invention.

FIG. 2 represents one embodiment for measuring nonimage area in this invention. In this figure, P is an electrophotographic photoreceptor, C is a light source, D is a cylindrical lens, E is an optical fiber, F is a photoelectronic detector, G is an amplifier circuit, H is a multiplexor, I is an AD converter, J is an image area converter and K is a replenishment system controller.

Figure 3:
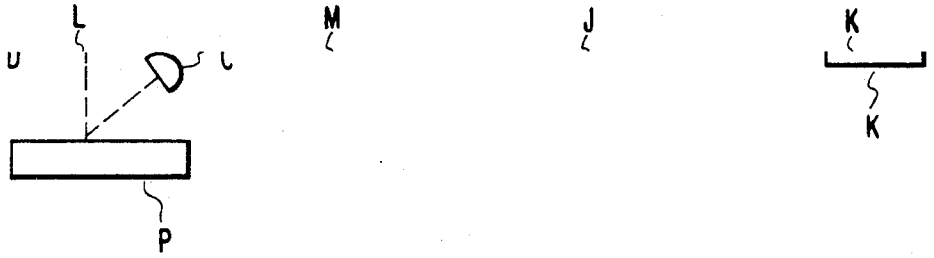

FIG. 3 also represents another embodiment for measuring nonimage area in this invention. In this figure, P, C, J and K are the same as those in FIG. 2, L is a camera tube and M is a detecting circuit for a color density difference between the image and nonimage area.

Aluminum sheet was sanded and anodized and a substrate was made, the coating fluid for the photoconductive layer mentioned below was coated on this substrate using a bar coater and it was dried for 10 minutes at 120° C. A large number of photoreceptors for use in electrophotographic plate making were thus made.

| Coating Fluid for Photoconductive Layer: | |
|---|---|
| The hydrazone compound given below: | 25 parts |

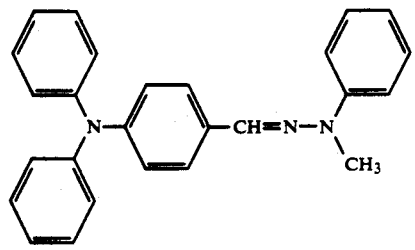

| | |
|---|---|
| Copolymer of benzyl methacrylate and methacrylic acid (methacrylic acid 30 mol %) | 75 parts |
| The thiopyrilium salt compound given below: | 1.18 parts |

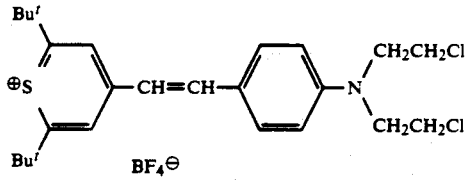

| | |
|---|---|
| Methylene chloride | 510 parts |
| Methyl cellosolve acetate | 150 parts |

The dry membrane thickness for the photoreceptor used in electrophotographic plate making produced in this way was 4 μm.

Next, the experimental materials were electrostatically charged with a surface potential of +400 V using a corona charger in a darkroom; base images were exposed with a tungsten lamp and it was found to be possible to obtain clear positive images by developing with a fluid developing agent (Ricoh's MRP, trade name, made by Ricoh Co., Ltd.). Next, the images created were heated for 2 minutes at 120° C. and the toner image was fixed and electrophotographic lithographic printing precursors were obtained.

A processing fluid consisting of 40 parts of potassium silicate, 10 parts of potassium hydroxide and 100 parts of ethanol was diluted in 800 parts of water to be used as the processing fluid for removing the nonimage area in the process described below. In addition, a fluid consisting of 4 parts of potassium silicate, 20 parts of potassium hydroxide and 40 parts of ethanol was diluted in 100 parts of water, and the thus-obtained fluid was used as the replenisher.

When the precursors on which the toner image had been formed were put into the processing system, first, the area of the nonimage area which was to be removed was detected and measured by the surface area measuring meter (1), following that, the precursors were processed by moving in succession from the processing fluid tank (2) to the water washing tank (3) to the drying zone (4). Data on the image area which had been measured by the surface area measuring meter (1) were input to the microcomputer (5) and these data were operation processed by a specified program in the microcomputer (5). Next, these data were sent to the replenisher adding mechanism (6), and the adding mechanism (6) added the specified volume of replenisher to the processing fluid tank (2) in accordance with the instructions. Because, in this manner, the volume of replenisher added is added directly and corresponds to the area of the image on the surface of the precursor, it is possible to effect the replenishment proportionately at all times.

The volume of the replenisher added in accordance with the value measured by the surface area measuring meter is a function of the concentration of the components in the replenisher. However, the relationship between the surface area of the nonimage area and the concentration can be determined, and it is possible to program both the surface area measuring meter and replenishment mechanism in the processor with this relationship.

The amount of the replenisher was fixed to 15 ml per $m^2$ of nonimage area.

In this example, the precursors having a total surface area of 40 $m^2$ could be processed consistently by using the processing fluid tank containing 4 liters of the processing fluid and adding the replenisher. On the other hand, when the processing was conducted using the processing fluid which was only circulated without adding replenisher, the precursors having a total surface area of less than 8 $m^2$ could be processed consistently and the processing could not be continued any more because of marked decrease of pH of the processing fluid.

The precursors enter the processor and pass through and are immersed in the above-mentioned processing fluid tank, or, when they pass over the tanks, they come into contact with the processing fluid via a roller which is half immersed in the fluid, in the tanks, or via a roller which has come to contain fluid via another roller, the processing fluids thus come to act on the photoconductive layer on the plate surface.

It is also possible to use the method of spraying the precursor with processing fluid inside the processor using a spray, etc. In this case, the processing fluid is brought to a nozzle by a pump from the processing fluid tank; the used fluid is then returned to the tank and reused. The above-mentioned replenisher is added to this processing fluid tank.

In the above-mentioned processing procedure, the nonimage area of the photoconductive layer is removed; this is effectively done by using a brush roller, etc., applied to the surface of the plate.

In accordance with this invention, a suitable amount of replenisher is automatically added to the processing fluid in accordance with the surface area of the nonimage area which has to be removed from the precursor, and thus deterioration of the processing fluid is avoided and it is possible to process a large number of precursors efficiently and consistently over lengthy periods of time.

While the invention has been described in detail and with reference to specific embodiments thereof, it will be apparent to one skilled in the art that various changes and modifications can be made therein without departing from the spirit and scope thereof.

What is claimed is:

1. A method for processing an electrophotographic lithographic printing plate precursor comprising a photoconductive layer provided on a conductive substrate, said photoconductive layer having a toner image formed thereon by an electrophotographic process, comprising measuring electronically the area of the nonimage area to be processed, treating said precursor with a processing fluid to remove the nonimage area of the photoconductive layer, and adding replenisher by automatic means in accordance with the area of the measured nonimage area.

2. A method as in claim 1, wherein said electronic measurement of the area of the nonimage area comprises irradiating the, surface of the photoconductive layer with a light and measuring the reflected light with a photoelectronic detector, said detector converting the measured light to an electronic signal which drives the automatic means for adding replenisher.

3. A method as in claim 2, wherein said light source is a diffuse light, and said photoelectronic detector is positioned at an angle of reflection with respect to the angle of incidence of said diffuse light source.

4. A method as in claim 2, wherein said photoelectronic detector is a photodiode.

5. A method as in claim 4, further comprising an amplifier circuit which amplifies the signal detected by the photodiode, a multiplexer which selectively inputs the signal from the amplifier circuit in accordance with an operation processing program, an AD converter capable of converting the output signal from the multiplexer into a digital signal, and microprocessors.

6. A method as in claim 2, wherein said light source is a laser.

7. A method as in claim 1, wherein said photoelectronic detector is a video camera, and wherein measurement of the nonimage area comprises converting a video signal made by scanning the surface of the image area with a video camera in accordance with an operation processing program.

* * * * *